US006821190B1

(12) United States Patent
Towery

(10) Patent No.: US 6,821,190 B1
(45) Date of Patent: Nov. 23, 2004

(54) STATIC PAD CONDITIONER

(75) Inventor: Daniel Lynne Towery, Penang (MY)

(73) Assignee: SilTerra Malaysia Sdn. Bhd. (MY)

( * ) Notice: Subject to any disclaimer, the term of this patent is extended or adjusted under 35 U.S.C. 154(b) by 41 days.

(21) Appl. No.: 10/140,350

(22) Filed: May 6, 2002

(51) Int. Cl.[7] ..... B24B 1/00; B24B 53/00

(52) U.S. Cl. ..... 451/41; 451/56; 451/287; 451/443; 451/444

(58) Field of Search ..... 451/41, 56, 443, 451/444

(56) References Cited

U.S. PATENT DOCUMENTS 3,596,649 A * 8/1971 Olivieri ..... 125/11.01
5,785,585 A 7/1998 Manfredi et al.
6,022,266 A * 2/2000 Bullard et al. ..... 451/56
6,152,813 A * 11/2000 Suzuki ..... 451/443
6,273,797 B1 * 8/2001 Becker et al. ..... 451/56
6,361,414 B1 * 3/2002 Ravkin et al. ..... 451/56
6,500,054 B1 * 12/2002 Ma et al. ..... 451/56
2001/0041520 A1 * 11/2001 Shin ..... 451/259
2003/0060103 A1 * 3/2003 Kramer ..... 451/20
2003/0082997 A1 * 5/2003 Jensen et al. ..... 451/41
2003/0084894 A1 * 5/2003 Sung ..... 125/12

* cited by examiner

*Primary Examiner*—M. Rachuba
(74) *Attorney, Agent, or Firm*—Townsend and Townsend and Crew LLP

(57) ABSTRACT

A chemical mechanical polishing apparatus includes a polishing pad. A pad conditioner includes a static conditioner head having a surface area configured to contact and condition the pad. The surface area has a first end proximate to an axis of rotation of the pad and a second end remote from the axis of rotation of the pad. The first end defines a first arc length, and the second end defines a second arc length, where the first arc length and the second arc length are substantially identical.

18 Claims, 5 Drawing Sheets

STATIC PAD CONDITIONER

BACKGROUND OF THE INVENTION

This invention relates generally to the planarization of semiconductor substrates, and more particularly to the conditioning of polishing pads.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes successively less planar. This non-planar outer surface presents a problem for the integrated circuit manufacturer as a non-planar surface can prevent proper focusing of the photolithography apparatus. Therefore, there is a need to planarize the substrate surface to provide a planar surface. Planarization, in effect, polishes away a non-planar, outer surface, whether a conductive, semiconductive or insulative layer, to form a relatively flat, smooth surface.

Chemical mechanical polishing ("CMP") is one accepted method of planarization. This planarization method typically requires that the substrate be mounted on a carrier or polishing head, with the surface of the substrate to be polished exposed. The substrate is then placed against a rotating polishing pad. The carrier head may also rotate and/or oscillate to provide additional motion between the substrate and polishing surface. Further, polishing slurry, including an abrasive and at least one chemically reactive agent, may be spread on the polishing pad to provide an abrasive chemical solution at the interface between the pad and substrate. In some specific applications the abrasive is entrained in, affixed to the surface of, the polishing pad.

Important factors in the chemical mechanical polishing process are: substrate surface planarity and uniformity, and the polishing rate. Inadequate planarity and uniformity can produce substrate defects. The polishing rate sets the time needed to polish a layer. Thus, it sets the maximum throughput of the polishing apparatus.

BRIEF SUMMARY OF THE INVENTION

In one embodiment, a chemical mechanical polishing apparatus includes a polishing pad. The pad conditioner includes a static conditioner head having a surface area configured to contact and condition the pad. The surface area has a first end proximate to an axis of rotation of the pad and a second end remote from the axis of rotation of the pad. The first end defines a first arc length, and the second end defines a second arc lengths where the first arc length and the second arc length are substantially identical.

In another embodiment, a chemical mechanical polishing apparatus includes a polishing pad, a wafer carrier carrying a wafer to be polished, and a pad conditioner including a static conditioner head having a surface area configured to contact and condition the pad. The static conditioner head is held at a fixed position. The surface area has a first end proximate to an axis of rotation of the pad and a second end remote from the axis of rotation of the pad. The first end defines a first arc length $S_1=R_1\theta_1$ and the second end defines a second arc length $S_2=R_2\theta_2$, where R is a radii from the axis of rotation and $\theta$ is an angle subtending an arc section corresponding to the R, wherein $S_1$ is substantially identical to $S_2$.

In another embodiment, a chemical mechanical polishing apparatus includes a polishing pad. The pad conditioner includes a static conditioner head having a surface area configured to contact and condition the pad. The surface area has a first end proximate to an axis of rotation of the pad and a second end remote from the axis of rotation of the pad. The first end defines a first width, and the second end defines a second width, where the first width is greater than the second width.

In another embodiment, a pad conditioner includes a static conditioner head having a non-smooth surface area to contact and condition the pad The surface area has a first end proximate to an axis of rotation of the pad and a second end remote from the axis of rotation of the pad. The first end defines a first arc length, and the second end defines a second arc length, where the first arc length and the second arc length are substantially identical.

In yet another embodiment, a method for operating a polishing apparatus includes polishing a wafer on a polishing pad rotating about an axis at a given speed. Slurry having a chemical agent and an abrasive agent to facilitate the wafer polishing is provided. A non-smooth area of a static conditioner head is contacted to the polishing pad to condition the polishing pad. The conditioner head is held at a fixed position. The non-smooth surface area has a first end proximate to the axis and a second end remote from the axis. The first end defines a first arc length, and the second end defines a second arc length, where the first arc length and the second arc length are substantially identical.

DETAILED DESCRIPTION OF THE INVENTION

Figure 1:
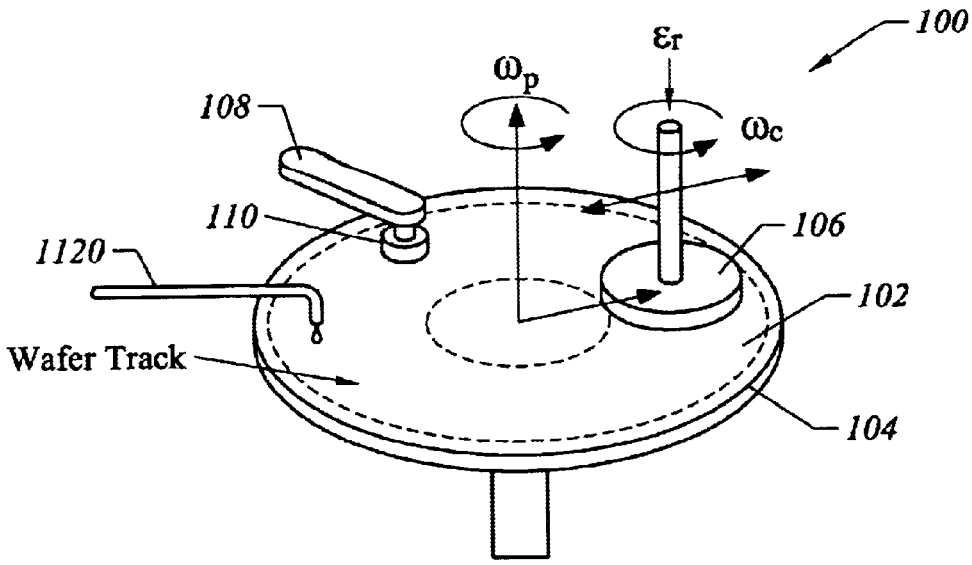
FIG. 1 illustrates a schematic view of a chemical mechanical polishing apparatus.

FIG. 1 illustrates a schematic perspective view of a CMP polishing apparatus 100. The apparatus 100 includes a rotatable platen 102 supporting a polishing pad 104 and a rotatable wafer carrier 106 carrying a wafer (not shown) using hydrodynamic forces. The platen is generally is rigid and may be temperature controlled. The polishing pad 104 is typically comprised of polyurethane or polyurethane impregnated fiber. The wafer carrier 106 has a retaining ring (not shown) to firmly hold the wafer therein during the polishing operation, at which time the wafer carrier oscillates back-and-forth and rotates against the polishing pad, as shown by the arrows in FIG. 1. The wafer carrier also applies a net downward force $F_t$ uniformly to various parts of the wafer, so that wafer is pressed against the pad during the polishing operation for uniform removal of material.

The apparatus also includes a pad conditioner 110 having a conditioner head 110 that is directed onto the polishing pad and a slurry dispenser 112 to supply slurry onto the polishing. The slurry includes chemically active and abrasive materials to enhance the wafer planarization. Accordingly, this polishing operation is commonly referred to a chemical mechanical polishing ("CMP") process.

The pad conditioner 110 is used to refresh or condition the polishing pad 104 to counteract the pad decay resulting from repeated polishing operations, so that high polishing efficiency and consistency from substrate to substrate may be maintained. An example of such pad decay is the glazing phenomenon that is a complex combination of contamination, thermal, chemical and mechanical damage to the pad material. When the polishing apparatus 100 is in operation, the pad is subject to compression, shear and friction producing heat and wear. Slurry and abraded material from the wafer and pad are pressed into the pores of the pad material and the material itself becomes matted and even partially fused. These effects reduce the pad's roughness and its ability to apply fresh slurry to the substrate.

Accordingly, the pad conditioner is used to continually condition the pad by removing trapped slurry, and unmatting or re-expanding the pad material. During conditioning, the conditioner head 110, generally made of diamond-impregnated ring or disk tools, is pressed against the rotating polishing pad. The pressure and relative motion of the conditioner head 110 erodes a small amount of pad material. Pad erosion is required to keep the surface of the pad free of the material build-up associated with the reaction products of CMP, i.e., spent abrasives and removed dielectric material. Pad conditioning also maintains the micro-texture or roughness of the pad, which tends to smooth during CMP in response to heat-induced viscoelastic flow.

A pad conditioning process whereby pad conditioning and wafer polishing occur simultaneously is referred to as "in-situ" conditioning. When pad conditioning occurs between the wafer polishing and the conditioning process, it is called "ex-situ" conditioning. The size of the conditioning tools depends on the CMP platform, but they are usually smaller in diameter than the polishing pad. Ring-conditioning tools are usually larger than the wafer diameter. In practice, ring-conditioning tools are positioned at a fixed radial distance (no oscillation) from the polishing pad's rotational axis. At this location the ring-conditioner rotates and provides the required erosion in the "wafer-track." The wafer-track is an annular zone on the polishing pad where the oscillating-wafer resides during CMP. Disk conditioners are typically smaller than the wafer, and their use requires that they oscillate across the pad surface to provide the necessary cover of the wafer-track. During pad conditioning, the location and rotation rate of the conditioning tools affect the uniformity of erosion in the wafer-track that influences the removal rate stability and polishing uniformity of the CMP process.

Figure 2:
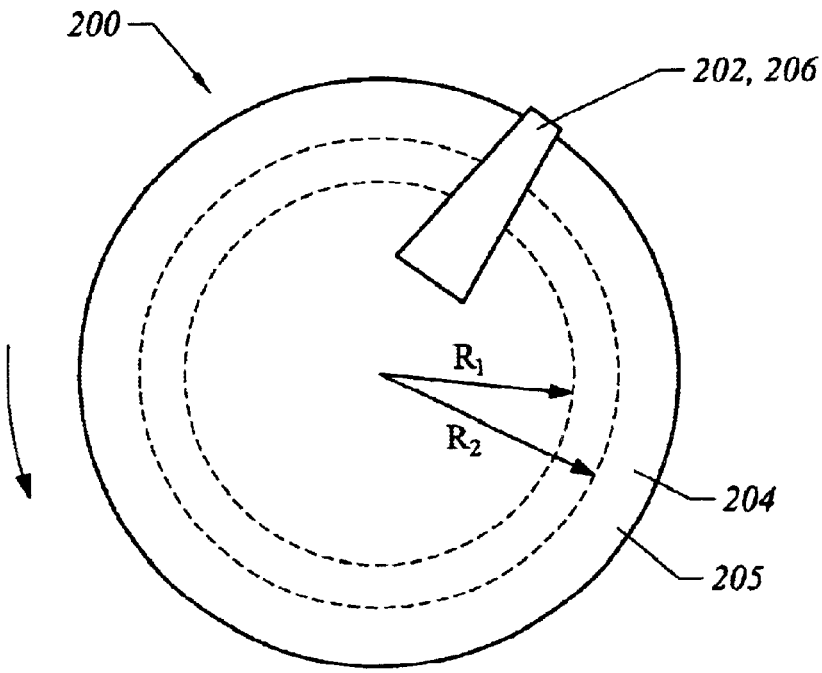
FIG. 2 illustrates a schematic top view of a conditioner head and a polishing pad according to one embodiment of the present invention.

FIG. 2 illustrates a schematic top view of a polishing apparatus 200 having a static pad conditioner 202 according to one embodiment of the present invention. The pad conditioner 202 is provided on a polishing pad 204 and has a conditioner head 206 for contacting the pad 204. Other features of the pad conditioner 202 are not depicted in FIG. 2 but are illustrated subsequently in FIGS. 6–8. FIG. 2 is shown for illustrative purposes, as with other figures herein, and does not accurately depict the actual dimensions of the pad conditioner and the polishing pad. In one embodiment, the pad conditioner 110 consists essentially of the conditioner head, in which case the downward force $F_N$ acting on the conditioner head is provided by its own weight.

Figure 3:
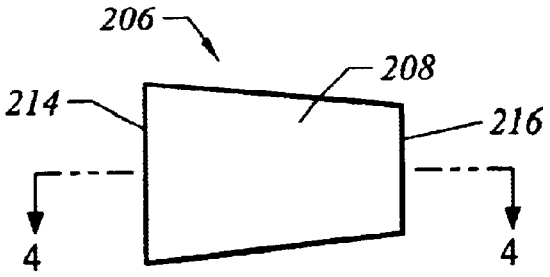
FIG. 3 illustrates a schematic top view of a conditioner head according to one embodiment of the present invention.

Referring to FIGS. 2 and 3, the conditioner head 206 is substantially planar and rigid and has a surface area 208 that is coated with a suitable abrasive material and is directed onto the rotating polishing pad 204 having a surface area 205. In one embodiment, the conditioner head is constructed of polished glass or ceramic. The surface area 208 of the pad conditioner that contacts the polishing pad is coated preferably with a chemically inert abrasive material, e.g., Diamond, BCN, SIC, SIN, $Al_2O_3$, or the like. The conditioner head is pressed against the pad with a controlled and uniformly distributed force.

Figure 4:
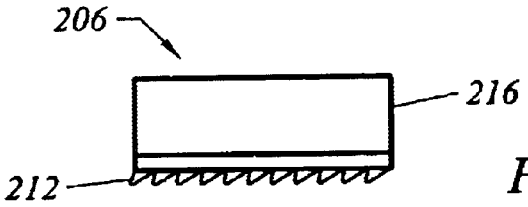
FIG. 4. illustrates a schematic cross-sectional view of the conditioner head taken along the arrow IV of FIG. 3 according to one embodiment of the present invention.

FIG. 4 shows a cross-sectional view of the conditioner head 206 taken along the arrows IV of FIG. 3. The conditioner head 206 includes a main body 210 and an abrasive material 212 coated thereon. In one embodiment, the entire conditioner head 206 is made of abrasive material.

Figure 5:
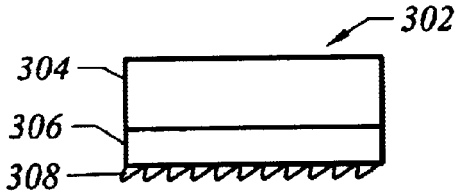
FIG. 5 illustrates a schematic cross-sectional view of a conditioner head according to another embodiment of the present invention.

FIG. 5 shows a cross-sectional view of a conditioner head 302 according to one embodiment of the present invention. The conditioner head 302 includes a main body 304 and a lower portion 306 that is removably joined to the main body. For example, the lower portion 306 may be screwed to the main body, adhesively coupled, clamped, or the like. The lower portion 306 includes an abrasive region 308 that is configured to contact and condition the polishing pad. The lower portion of the conditioner head 302 may be replaced with a new lower portion after it becomes worn after repeated conditioning.

Figure 6:
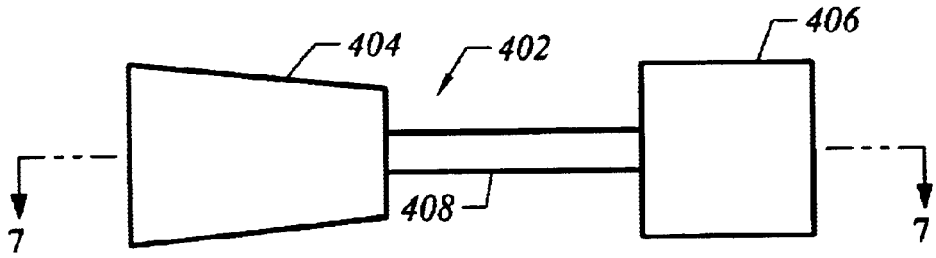
FIG. 6 illustrates a schematic top view of a pad conditioner according to one embodiment of the present invention.

FIG. 6 shows a schematic top view of a pad conditioner 402 according to one embodiment of the present invention. The pad conditioner 402 includes a conditioner head 404, a base 406 to support the conditioner head 404, and a shaft 408 coupled to the conditioner head 404 at one end and the base at the other end.

Figure 7:
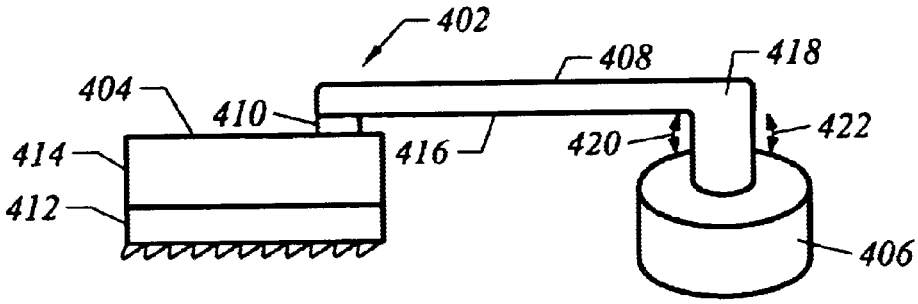
FIG. 7 illustrates a schematic cross-sectional view of the pad conditioner taken along the arrow VII of FIG. 6 according to one embodiment of the present invention.

FIG. 7 shows a schematic cross-sectional view of the pad condition 402 taken along the arrows VII of FIG. 6. The pad conditioner 402 includes a connector 410 that couples the conditioner head 404 and the shaft 408. In one embodiment, the connector 410 may removably couple or join the conditioner head 404 and the shaft 408, so that the conditioner head 404 may be replaced with a new conditioner head after the former becomes worn upon repeated use.

In one embodiment, the conditioner head 404 may include a lower portion 412 that is removably coupled or joined to the main body 414, as in the conditioner head 302 of FIG. 5. The lower portion 412, rather than the entire conditioner head 404, is replaced after it becomes worn as in the conditioner head 302 of FIG. 5. The conditioner head 404 may be decoupled from the shaft 408 in order to replace the worn lower portion.

In one embodiment, the shaft 408 includes a horizontal portion 416 and a vertical portion 418. The horizontal portion is coupled to the connector 410 at one end and the vertical portion at the other end. The vertical portion, in turn, is coupled to the base 406. The base includes a horizontal motor (not shown) and a vertical motor (not shown). The horizontal motor enables the vertical portion 418 of the shaft to rotate in a direction parallel to the polishing pad, i.e., in the direction of an arrow 420, so that the conditioner head may be positioned above the polishing pad to prepare the pad conditioner 402 for a conditioning operation. The conditioner head may be rotated off or otherwise removed from the polishing pad once the conditioning operation has been completed or if the conditioner head 404 needs to be replaced. The conditioner head preferably is replaced away from the polishing pad to prevent the pad from being contaminated with falling debris. The vertical motor enables the vertical portion 418 of the shaft to move in a direction perpendicular to the polishing pad, i.e., in the direction of an arrow 422, so that the conditioner head 404 may be pressed against the polishing pad to commence a conditioning operation.

Figure 8:
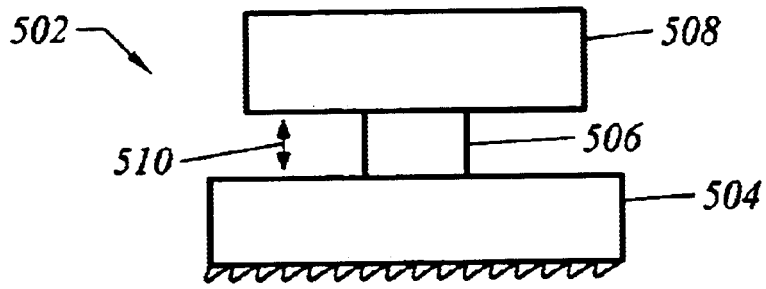
FIG. 8 illustrates a schematic cross-sectional view of a pad conditioner according to another embodiment of the present invention.

FIG. 8 shows a schematic cross-sectional view of the pad condition 502 according to one embodiment of the present invention. The pad conditioner 502 includes a conditioner head 504, a vertical shaft 506, and a base 508. The base 508 includes a motor (not shown) that enables the vertical shaft 418 to move in a perpendicular direction to the polishing pad, i.e., in the direction of an arrow 510, so that the conditioner head 404 may be pressed against the polishing pad to commence a conditioning operation.

Referring back to FIGS. 2 and 4, in one embodiment, the surface area 208 of the conditioner head 206 is configured to have a shape such that the arc length S of any point on the pad 204 within the wafer tracks, e.g., tracks R1 and R2, is independent of the radial distance of the point with respect to the pad's rotational axis (typically geometric center). Thus, as the pad rotates beneath the surface 208, each point experiences a uniform relative displacement across the surface 208. This conditioner head configuration enables uniform material removal or conditioning on these points and across all points within the wafer track.

During pad conditioning, pad material is removed by mechanical abrasion via the abrasive material provided on the surface area 208. Moving the polishing pad relative to the pad conditioner generates mechanical energy. The relative motion generates mechanical energy W as follows:

$$W=\int F_N \mu_s \cdot ds, \quad (1)$$

where $F_N$ is the total force normal to the pad surface, $\mu_s$ is the coefficient of sliding friction between the pad and the pad conditioner, and ds is a differential element of length. In other words, mechanical work is defined by Force x Distance. Accordingly, assuming the conditioner head is applied to the polishing pad with a constant and uniform force, it follows from the above equation (1) that the material removal during pad conditioning is directly proportional to the displacement between the pad conditioner and the polishing pad.

Figure 9:
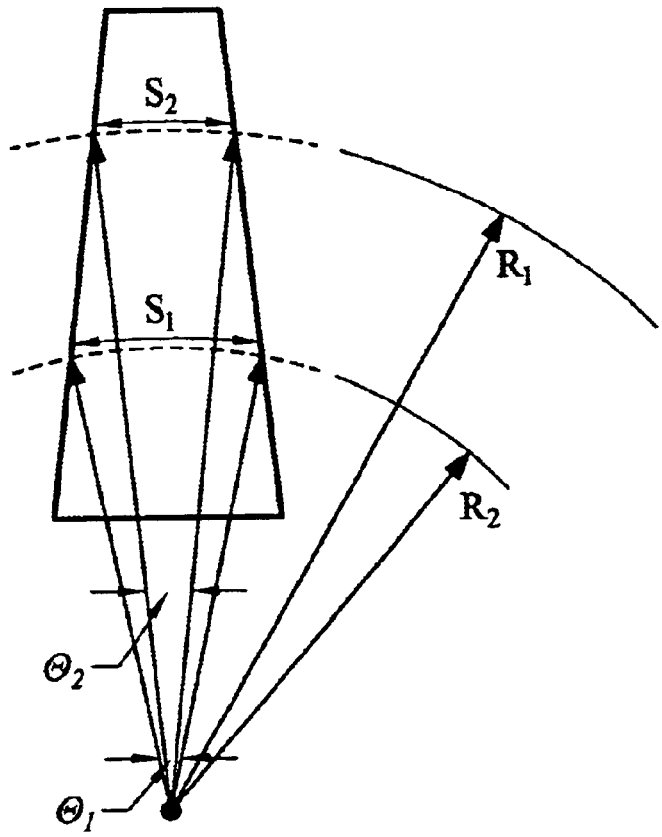
FIG. 9 illustrates a schematic, enlarged top view of a conditioner head and a polishing pad according to one embodiment of the present invention.

FIG. 9 shows an enlarged view of a relevant portion of FIG. 2 illustrating the surface 208 and two hypothetical arc paths on the polishing pad 204 that are traveling under the surface area 208. The arc length S of a circular arc section subtended by an angle θ (expressed in radiant) can be expressed as follows:

$$S=R\cdot\theta \quad (2)$$

Thus, the arc length for the outer radii $R_2$ is $S_2=R_2\times\theta_2$, and that for the inner radii $R_1$ is $S_1=R_1\times\theta_1$. According to the equation (1), if $S_1=S_2$, then the mechanical work, and therefore material removal, shall be equal at those points on the polishing pads located at a radius of $R_1$ and $R_2$. Such a condition can be obtained by controlling the angle θ subtending the edges of the pad conditioners to satisfy the following relationship:

$$R_1\theta_1=R_2\theta_2 \text{ or } S_1=S_2 \quad (3)$$

Based on the above, the dimension of the surface area 208 of a conditioner head is configured, so that as the radius increases linearly, the angle θ is decreased by a proportional amount according to one embodiment of the present invention. The shape of the conditioner head or surface 208 is determined using the above principle. The pad conditioner's length is determined preferably by the width of the wafer track since the length preferably is slightly longer than the wafer track to ensure that the pad is evenly applied over a length scale comparable or larger than the wafer track itself. The size of the annular wafer track includes the wafer diameter, retaining ring width, and an additional amount for wafer oscillation.

Below is a Table and Graph (FIG. 10) illustrating a static pad conditioner according to one embodiment of the present invention. The pad conditioner is provided with a length of 10 inches to sufficiently cover the wafer-track for an 8-inch wafer, assuming the oscillation during CMP, plus twice the retaining ring width, is <2". As shown below, a constant arc length is maintained by varying the angle from 180 degrees (Rn1=1 inch) to 18 degrees (Rn2 =10 inches). Accordingly, one end of a conditioner head of the pad conditioner is provided with a groove that extends inwardly from that end to another end at the opposing side (see FIG. 11) to enable the pad conditioner to apply a uniform pressure on the polishing pad being contacted by the surface area of the conditioner head.

Table of values for one embodiment of the static pad conditioner

| (R) Inches | Radians | Degrees | (S) Inches |
|---|---|---|---|
| 1.00 | 3.141593 | 180.000000 | 3.141593 |
| 1.50 | 2.094395 | 120.000000 | 3.141593 |
| 2.00 | 1.570796 | 90.000000 | 3.141593 |
| 2.50 | 1.256637 | 72.000000 | 3.141593 |
| 3.00 | 1.047198 | 60.000000 | 3.141593 |
| 3.50 | 0.897598 | 51.428571 | 3.141593 |
| 4.00 | 0.785396 | 45.000000 | 3.141593 |
| 4.50 | 0.698132 | 40.000000 | 3.141593 |
| 5.00 | 0.628319 | 36.000000 | 3.141593 |
| 5.50 | 0.571199 | 32.727273 | 3.141593 |
| 6.00 | 0.523599 | 30.000000 | 3.141593 |
| 6.50 | 0.483322 | 27.692308 | 3.141593 |
| 7.00 | 0.448799 | 25.714286 | 3.141593 |
| 7.50 | 0.418879 | 24.000000 | 3.141593 |
| 8.00 | 0.392699 | 22.500000 | 3.141593 |
| 8.50 | 0.369599 | 21.176471 | 3.141593 |
| 9.00 | 0.349066 | 20.000000 | 3.141593 |
| 9.50 | 0.330694 | 18.947368 | 3.141593 |
| 10.00 | 0.314159 | 18.000000 | 3.141593 |

Figure 10:
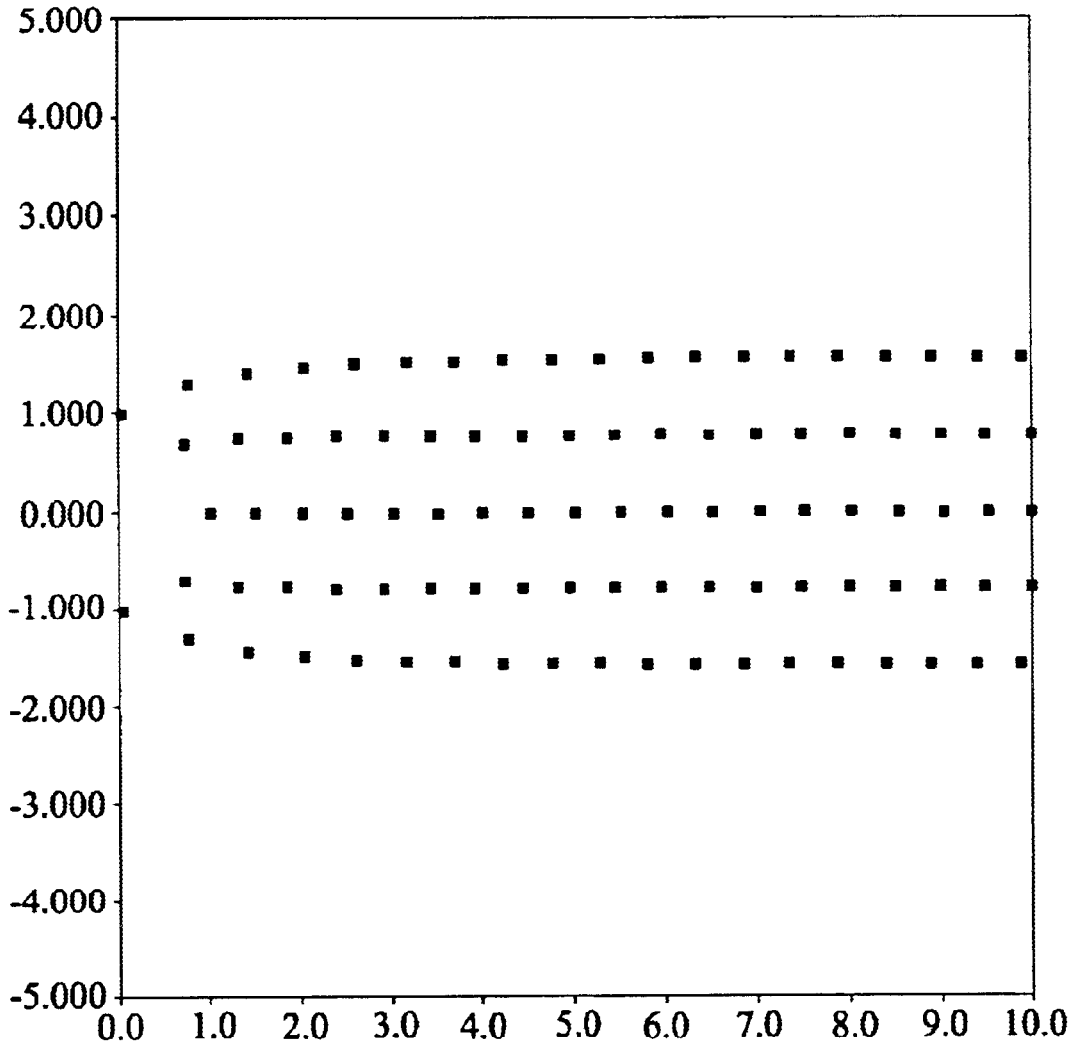
FIG. 10 illustrates a graph showing a preferred shape of a conditioner head according to one embodiment of the present invention.
Figure 11:
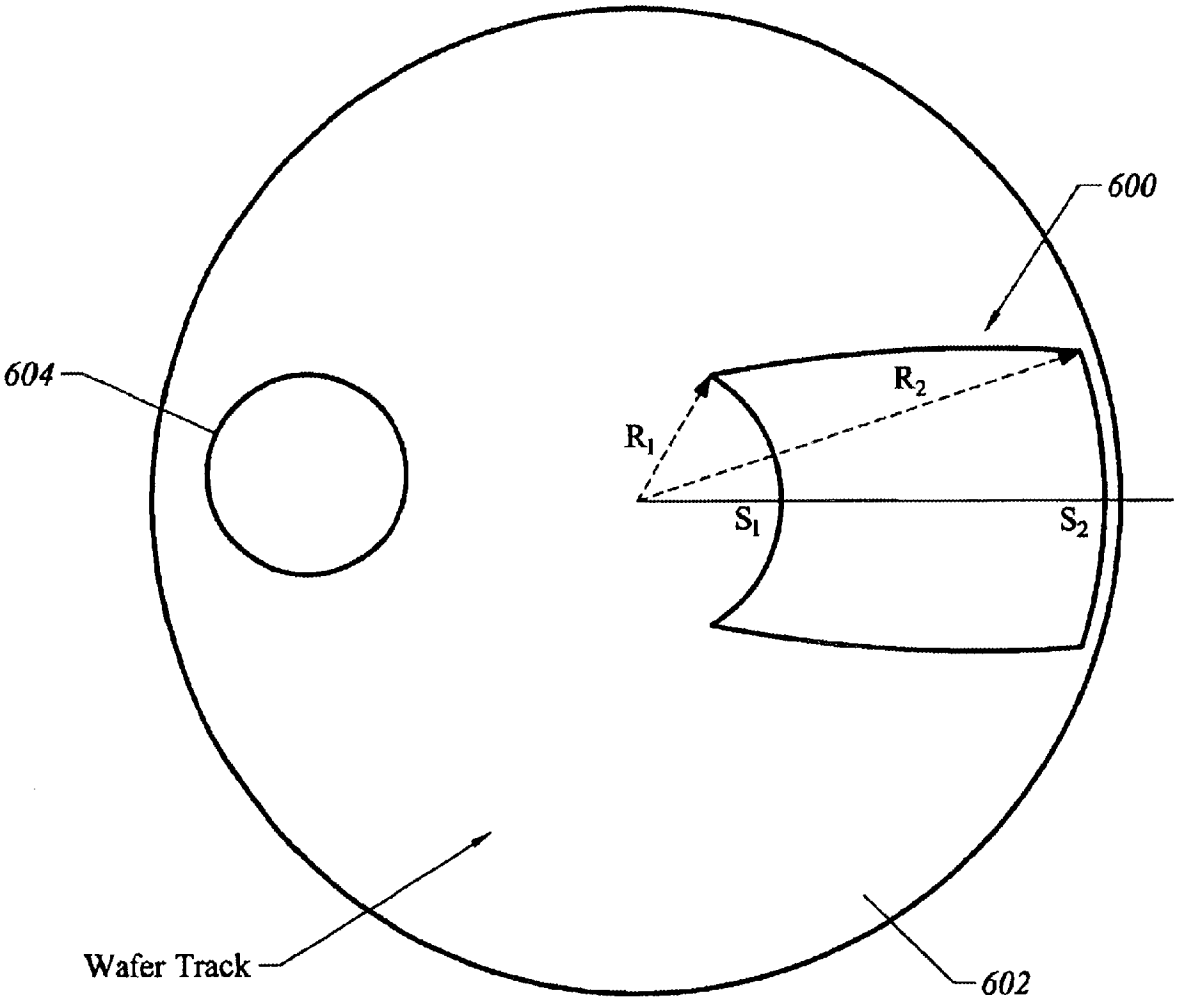
FIG. 11 illustrates a top view of a static pad conditioner according to one embodiment of the present invention.

Referring to FIG. 10, the shape of a static conditioner head is nearly rectangular at large values of R but tapers off as R decreases. The X-axis represents the length of the pad conditioner, and the Y-axis represents the width of the pad conditioner. By inspection and referring to the equation (1), a simple rectangular conditioner head would wear the polishing pad faster towards the center of the pad, i.e., at R=0. FIG. 11 illustrates a schematic top view of a static pad conditioner 600 satisfying the dimensions disclosed in the Table and Graph provided above. The pad conditioner (or the conditioner head of the pad conditioner contacting the polishing pad) has a groove defined by a first end of the conditioner head. The first end is proximate the center of the polishing pad in the present implementation. The groove extends toward a second end of the conditioner head that is at the opposing side of the first end. FIG. 11 also illustrates top views of a polishing pad 602 and a wafer 604 being polished thereon.

While the above embodiments describes the present invention fully, they are provided merely to illustrate the invention. Other modifications or alterations are within the scope of the present invention. For example, the force $F_N$ may be provided by a gas or fluid-filled bladder coupled to the main body 304 and a mechanical assembly, which is firmly attached to the frame of the polishing apparatus. By controlling the pressure within the bladder, a uniform force could be applied to the area of the polishing pad that is contacting the surface area.

In another embodiment, a non-uniform force $F_N$ may be provided by any means to the main body 304 and a mechanical assembly, which is firmly attached to the frame of the polishing apparatus. By controlling the pressure distribution on the main body or mechanical assembly, a non-uniform pressure could be applied to the area of the polishing pad that is contacting the surface area thereby affecting un-even pad wear, which may be desirable in some specific applications.

In another embodiment, the static pad conditioning concept described above could be extended to the design of a polishing machine where the object being polished is an annulus or a solid disk, where the area being polished is an annular region and the polishing pad shape is of the ideal shape as described herein.

In addition, the concept described above is applicable to other systems where uniform translation, polishing, grinding, or any other form of mechanical, physical, or electrical contact is desirable in an annular region of a rotating disk and another contacting body. Examples includes, but not limited to, pad conditioning systems for other polishing systems, such as those in the disk drive industry, the lens/glass polish industry, or the broader semiconductor industry where lapping or polishing is required.

Alternatively, embodiments of the present invention may be applied to disk brake systems or electrical brush contacts for effecting an electrical connection between the brush and a conductive rotating plate. Accordingly, the embodiments described above should not be used to limit the scope of the present invention. Rather, the scope of the present invention should be interpreted based on the appended claims.

What is claimed is:

1. A chemical mechanical polishing apparatus, comprising:

a polishing pad; and a pad conditioner including a static conditioner head having a surface area configured to contact and condition the pad, the surface area having a first end proximate to an axis of rotation of the pad and a second end remote from the axis of rotation of the pad, the first end defining a first arc length and the second end defining a second arc length, the first arc length and the second arc length being substantially identical, wherein the first end defines a groove that extends inwardly toward the second end to enable the conditioner head to apply a uniform pressure on the polishing pad being contacted by the surface area of the conditioner head.

2. The polishing apparatus of claim 1, wherein the surface area of the conditioner head defines a plurality of arc lengths expressed as $S=R\cdot\theta$, where R is a radii from the axis of rotation and $\theta$ is an angle subtending an arc section corresponding to the R, wherein the plurality of arc lengths are substantially the same, wherein the surface area contacting the polishing pad is shaped to apply the uniform pressure on the polishing pad.

3. The polishing apparatus of claim 1, wherein the surface area of the conditioner head defining an inner arc length $S_1=R_1\theta_1$ and an outer arc length $S_2=R_2\theta_2$, where R is a radii from the axis of rotation and $\theta$ is an angle subtending an arc section corresponding to the R, wherein $S_1=S_2$.

4. The polishing apparatus of claim 1, wherein the pad conditioner further includes:

a shaft having a first end coupled to the conditioner head and a second end; and a base to support the shaft and the conditioner head, the base being coupled to the second end of the shaft.

5. The polishing apparatus of claim 1, further comprising:

a wafer carrier carrying a wafer to be polished, wherein the pad conditioner is operated to condition the pad while the wafer is being polishing on the pad.

6. The polishing apparatus of claim 5, wherein the surface area of the conditioner head has a length that is equal or greater than a wafer track defined by the wafer.

7. The polishing apparatus of claim 1, wherein the static conditioner head does not oscillate or rotate.

8. A chemical mechanical polishing apparatus, comprising:

a polishing pad;

a wafer carrier carrying a wafer to be polished; and a pad conditioner including a non-rotating and non-oscillating conditioner head having a surface area configured to contact and condition the pad, the static conditioner head being held at a fixed position, the surface area having a first end proximate to an axis of rotation of the pad and a second end remote from the axis of rotation of the pad, wherein the first end defines a first arc length $S_1=R_1\theta_1$ and the second end defines a second arc length $S_2=R_2\theta_2$, where R is a radii from the axis of rotation and $\theta$ is an angle subtending an arc section corresponding to the R, wherein $S_1$ is substantially identical to $S_2$, wherein the surface area contacting the polishing pad is shaped to apply a uniform pressure on the polishing pad being contacted regardless of the distance from the axis of rotation of the pad.

9. The polishing apparatus of claim 8, wherein the pad conditioner consists essentially of the conditioner head.

10. The polishing apparatus of claim 2, wherein the conditioner head includes:

a main body; and a lower portion coupled to the main body having a non-smooth area to contact and condition the pad.

11. The polishing apparatus of claim 10, wherein the lower portion is removably coupled to the main body, so that the lower portion can be removed when it becomes worn.

12. The polishing apparatus of claim 8, wherein the surface area defines a plurality of arc lengths, the plurality of arc lengths being substantially the same, wherein the first end defines a groove that extends inwardly toward the second end to enable the conditioner head to apply a uniform pressure on the polishing pad being contacted.

13. A pad conditioner, comprising:

a static conditioner head having a non-smooth surface area to contact and condition the pad, the surface area having a first end proximate to an axis of rotation of the pad and a second end remote from the axis of rotation of the pad, the first end defining a first arc length and the second end defining a second arc length, the first arc length and the second arc length being substantially identical, wherein the first end defines a groove that extends inwardly toward the second end to enable the conditioner head to apply a uniform pressure on the polishing pad being contacted.

14. The polishing apparatus of claim 13, wherein the surface area of the conditioner head defines a plurality of arc lengths expressed as $S=R\cdot\theta$, where R is a radii from the axis of rotation and $\theta$ is an angle subtending an arc section corresponding to the R, wherein the plurality of arc lengths are substantially the same.

15. The polishing apparatus of claim 13, wherein the conditioner head includes:

a main body; and a lower portion coupled to the main whereon the non-smooth area is provided.

16. The polishing apparatus of claim 15, wherein the lower portion is removably coupled to the main body, so that the lower portion can be removed when it becomes worn.

17. The polishing apparatus of claim 13, wherein the static conditioner head is held at a fixed position and does not oscillate or rotate.

18. A method for operating a polishing apparatus, comprising:

polishing a wafer on a polishing pad rotating about an axis at a given speed;

providing slurry having a chemical agent and an abrasive agent to facilitate the wafer polishing; and contacting a non-smooth area of a static conditioner head to the polishing pad to condition the polishing pad, the conditioner head being held at a fixed position, the non-smooth surface area having a first end proximate to the axis and a second end remote from the axis, the first end defining a first arc length and the second end defining a second arc length, the first arc length and the second arc length being substantially identical, wherein the first end defines a groove that extends inwardly toward the second end to enable the conditioner head to apply a uniform pressure on the polishing pad being contacted.

* * * * *